US007127190B2

(12) United States Patent
Gumbe

(10) Patent No.: US 7,127,190 B2
(45) Date of Patent: Oct. 24, 2006

(54) CHARGER CLEANING DEVICE, CHARGER CLEANING METHOD AND IMAGE FORMING APPARATUS

(75) Inventor: Eiji Gumbe, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 115 days.

(21) Appl. No.: 11/041,261

(22) Filed: Jan. 25, 2005

(65) Prior Publication Data

US 2006/0165430 A1 Jul. 27, 2006

(51) Int. Cl.
*G03G 15/02* (2006.01)

(52) U.S. Cl. ..... 399/100; 399/170; 399/171; 399/172

(58) Field of Classification Search ..... 399/100, 399/115, 170, 171, 172, 173
See application file for complete search history.

(56) References Cited

U.S. PATENT DOCUMENTS 6,415,120 B1 * 7/2002 Tashiro et al. ..... 399/100
2005/0063727 A1 * 3/2005 Quinones ..... 399/100

FOREIGN PATENT DOCUMENTS

JP 7-261520 A 10/1995

* cited by examiner

*Primary Examiner*—Hoang Ngo
(74) *Attorney, Agent, or Firm*—Foley & Lardner LLP

(57) ABSTRACT

The present invention drives cleaning member moving devices for moving cleaning members of a plurality of chargers at the same time by a single cleaning motor to miniaturize an image forming apparatus and reduce the cost. Further, at the end time of cleaning, all the cleaning members are shifted to a predetermined area by the cleaning member moving devices, and the cleaning motor is stopped, thus the cleaning members remain in a charging area, and uneven charging is prevented.

21 Claims, 6 Drawing Sheets

CHARGER CLEANING DEVICE, CHARGER CLEANING METHOD AND IMAGE FORMING APPARATUS

BACKGROUND OF THE INVENTION

1. Field of the Invention

The present invention relates to a charger cleaning device and a charger cleaning method for cleaning a wire-shaped corona discharge member of a charger used for a copier for obtaining color images by the tandem method and a printer and to an image forming apparatus.

2. Description of Related Art

In recent years, in an image forming apparatus of an electro-photographic type such as a copier and a printer, to evenly charge a photosensitive drum, transfer toner images, or separate sheets of paper, a charger by corona discharge has been used. The charger by corona discharge has an advantage that the constitution is simple and stable charging is obtained. However, while the charger by corona discharge is in use, a wire-shaped corona discharge member or a needle-shaped corona discharge member installed on a metallic sheet is contaminated. Contamination of the corona discharge member is caused by an oxide generated on the surface of the corona discharge member or foreign substances such as toner or paper powder.

When the corona discharge member of the charger is contaminated, uneven charging is generated on the photosensitive drum, and defective images are caused due to a reduction in the transfer efficiency of toner images, or a separation error occurs in sheets of paper. Therefore, in Japanese Patent Application Publication No. 7-261520, an image forming apparatus for sliding a cleaning pad for cleaning a charge wire on the charge wire is disclosed. However, this conventional image forming apparatus has a structure using one cleaning motor to slide one cleaning pad 1.

On the other hand, in an image forming apparatus such as a copier or a printer, an image forming apparatus of the tandem type for multi-transferring toner images formed respectively on a plurality of photosensitive drums arranged side by side on one sheet of paper to obtain a color image is known. In such an image forming apparatus of the tandem type, in recent years, although a plurality of photosensitive drums are used, a miniature one has been required.

However, to apply the charge wire cleaning device of the aforementioned conventional image forming apparatus to the image forming apparatus of the tandem type, a cleaning motor is required for each charge wire cleaning device. Therefore, for example, in an image forming apparatus of a 4-tandem type, four cleaning motors must be installed to drive the respective charge wire cleaning devices, thus the miniaturization thereof is impaired, and the cost is increased.

Therefore, in the image forming apparatus of the tandem type, although a cleaning device for maintaining the image quality is installed in each of a plurality of chargers arranged side by side, a charger cleaning device and an image forming apparatus which can realize miniaturization and cost reduction of the image forming apparatus are desired.

SUMMARY OF THE INVENTION

An object of the present invention is to realize miniaturization and reduction in cost of an image forming apparatus having cleaning devices for cleaning corona discharge members of a plurality of chargers and to obtain a high image quality.

According to the embodiment of the present invention, there is provided a charger cleaning devices comprising: a plurality of cleaning members sliding respectively on wire-shaped corona discharge members of a plurality of chargers arranged side by side for removing foreign substances of the corona discharge members; a plurality of cleaning member moving means for moving the plurality of cleaning members respectively along the corona discharge members; a single drive source for driving the plurality of cleaning member moving means for the plurality of chargers at the same time; a plurality of drive transferring means for transferring driving force of the single drive source respectively to the plurality of cleaning member moving means; and releasing means for releasing, when the cleaning members are returned to predetermined positions for the plurality of chargers, the transfer of the driving force of the drive source by the drive transferring means, wherein in all the chargers, when the cleaning members are returned to the predetermined positions, the drive source is stopped.

DETAILED DESCRIPTION OF THE EMBODIMENTS

Figure 1:
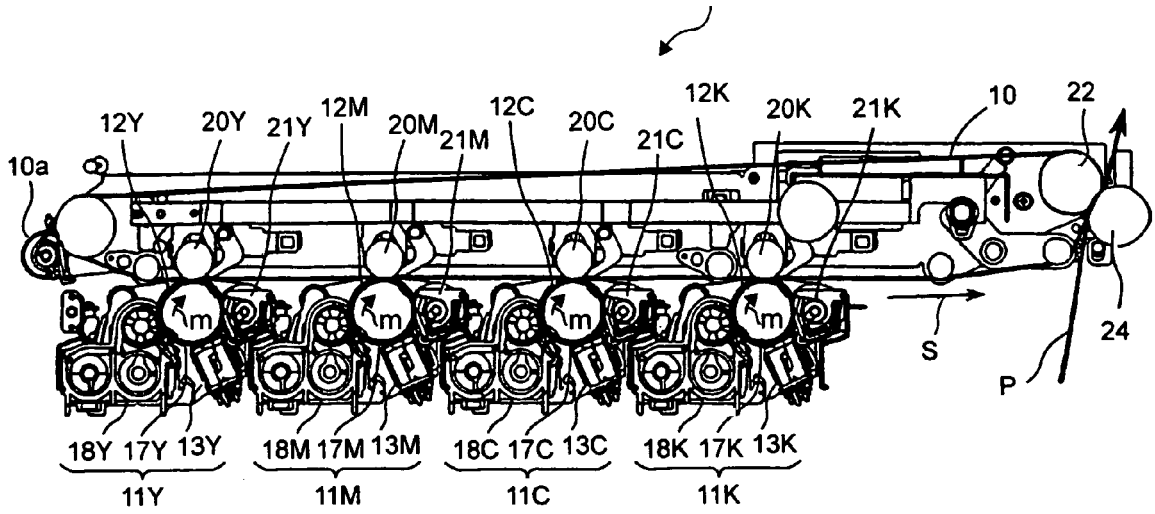
FIG. 1 is a schematic block diagram showing the image forming unit of the color copier of the embodiment of the present invention.

Hereinafter, the embodiment of the present invention will be explained in detail with reference to the accompanying drawings. FIG. 1 is a schematic block diagram showing image forming unit 1 of a color copier of a four-tandem type which is an embodiment of the present invention and an image forming apparatus. Image forming unit 1 has four sets of process units 11Y, 11M, 11C, and 11K of yellow (Y), magenta (M), cyan (C), and black (K) which are arranged in parallel along the lower side of intermediate transfer belt 10 which is an intermediate transfer medium.

Process units 11Y, 11M, 11C, and 11K respectively have photosensitive drums 12Y, 12M, 12C, and 12K which are image carrying members. At the primary transfer positions opposite to photosensitive drums 12Y, 12M, 12C, and 12K of intermediate transfer belt 10, primary transfer voltages are applied by primary transfer rollers 20Y, 20M, 20C, and 12K and the toner images on photosensitive drums 12Y, 12M, 12C, and 12K are transferred primarily to the intermediate transfer belt.

At the secondary transfer position supported by drive roller 22 for stretching and suspending intermediate transfer belt 10, secondary roller 24 is arranged opposite to it. At the secondary transfer position, a secondary transfer voltage is applied by secondary transfer roller 24 via sheet of paper P and the toner image on intermediate transfer belt 10 is transferred secondarily onto sheet of paper P. On the downstream side of secondary transfer roller 26 of intermediate transfer belt 10, belt cleaner 10*a* is installed.

Figure 2:
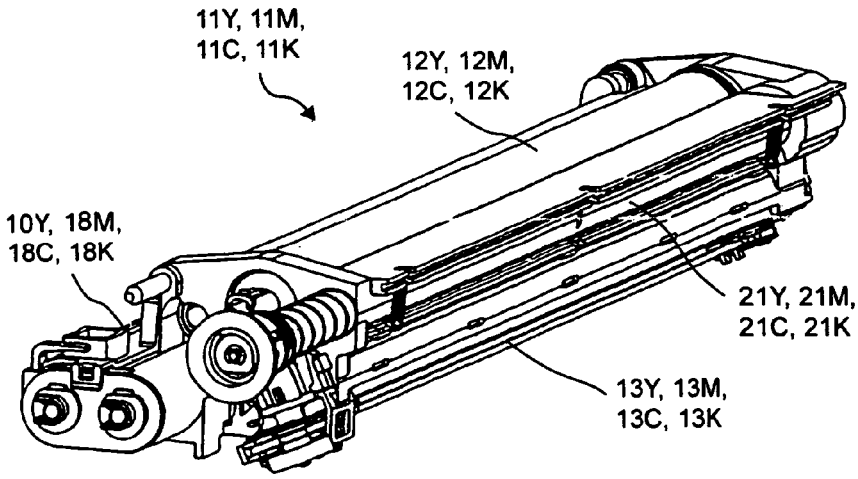
FIG. 2 is a perspective view showing one of the process units of the embodiment of the present invention.

On process units 11Y, 11M, 11C, and 11K, as shown in FIGS. 1 and 2, respectively around photosensitive drums 12Y, 12M, 12C, and 12K, in the rotational direction of arrow m, chargers 13Y, 13M, 13C, and 13K, exposure positions 17Y, 17M, 17C, and 17K of laser beams of various colors irradiated from laser exposure device 16, developing units 18Y, 18M, 18C, and 18K, and photoconductor cleaning devices 21Y, 21M, 21C, and 21K are arranged. To exposure positions 17Y, 17M, 17C, and 17K, laser beams of various colors are irradiated from a laser exposure device not shown in the drawing.

Next, chargers 13Y, 13M, 13C, and 13K will be explained in detail. Chargers 13Y, 13M, 13C, and 13K have the same structure, so that they will be explained using the common numerals. Chargers 13Y, 13M, 13C, and 13K, in charger case 24, have wire-shaped corona discharge members 26 for uniformly charging overall the surfaces of photosensitive drums 12Y, 12M, 12C, and 12K. Each corona discharge member 26 is composed of needle-shaped projection 26*b* formed on thin metallic plate 26*a* and discharges a corona from the front end of needle-shaped projection 26*b*. Further, chargers 13Y, 13M, 13C, and 13K have charger cleaning devices 27 for cleaning oxides deposited on corona discharge members 26 by ozone and contaminants such as floating toner and paper powder.

Figure 3:
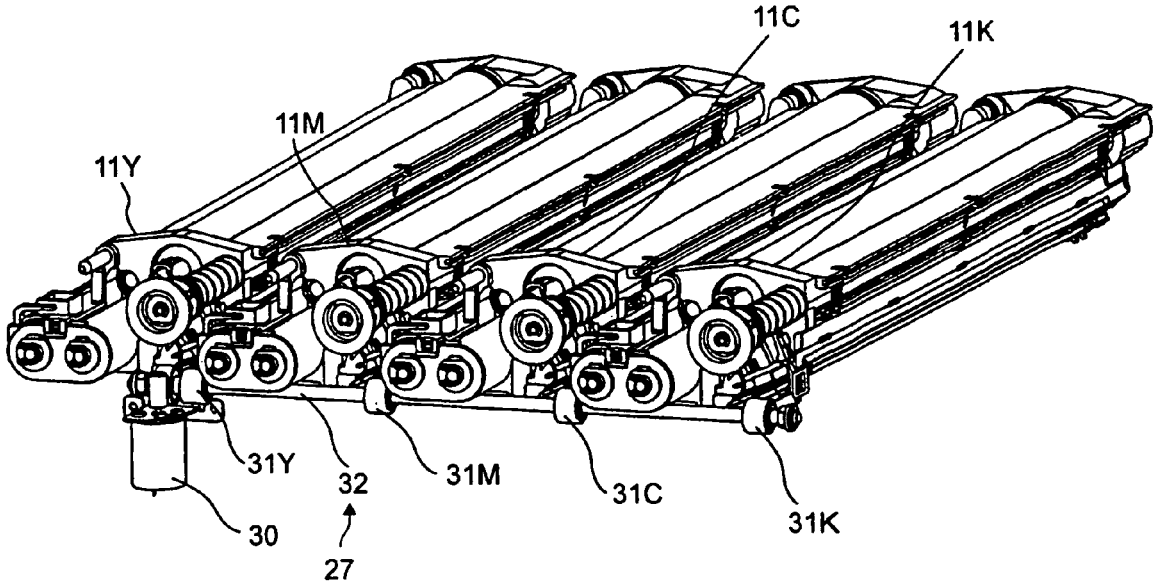
FIG. 3 is a perspective view showing the cleaning motors and drive transfer devices of the four process units of the embodiment of the present invention.
Figure 4:
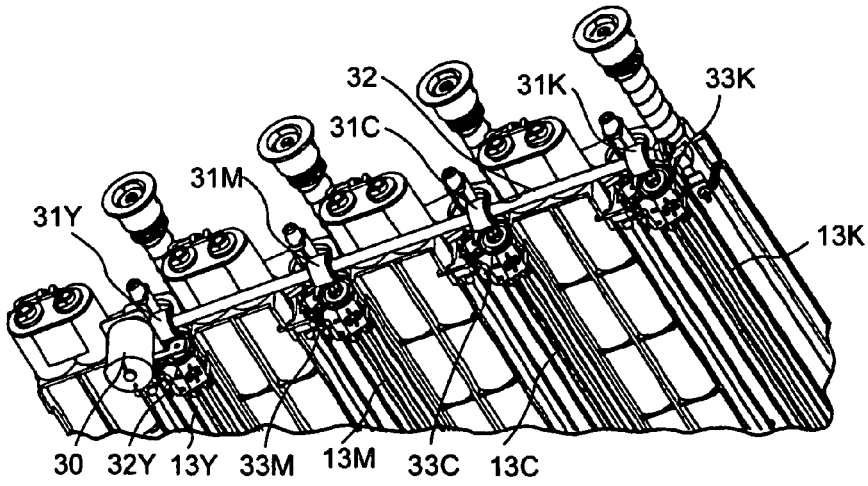
FIG. 4 is a partial perspective view showing the cleaning motors and drive transfer devices of the embodiment of the present invention which are viewed from underneath.
Figure 5:
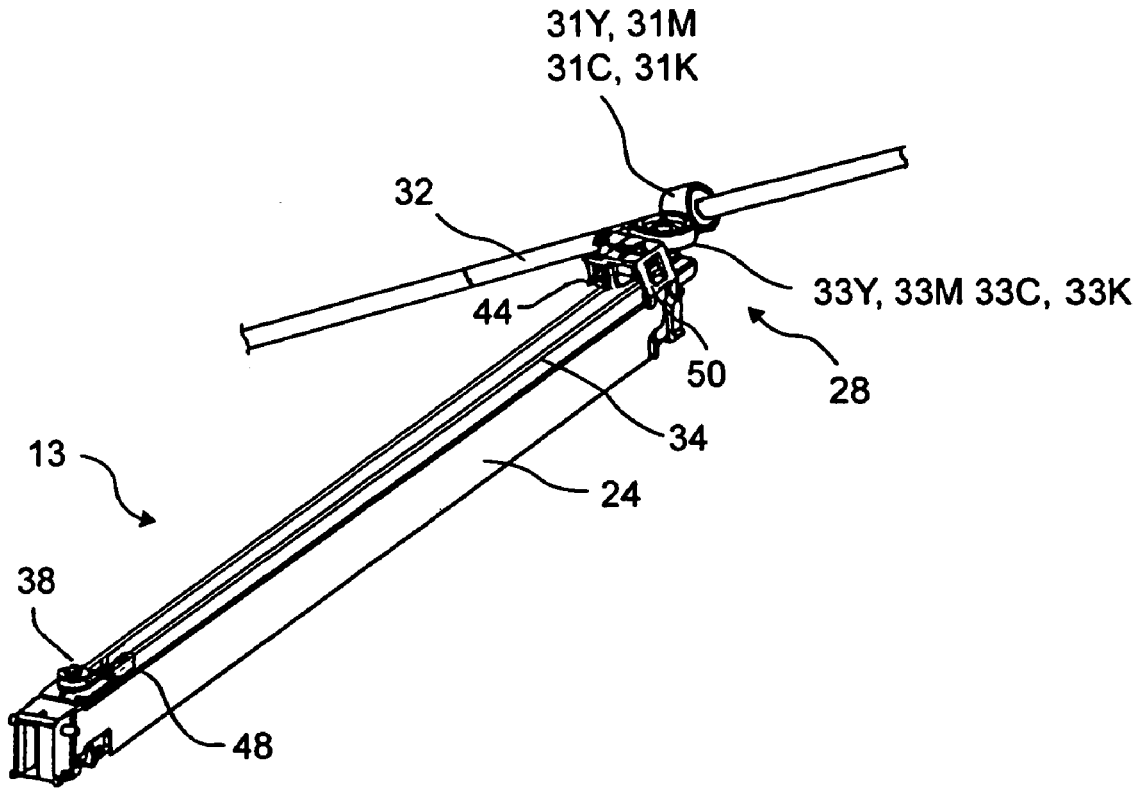
FIG. 5 is a perspective view showing the cleaning motor and drive transfer device of the embodiment of the present invention.
Figure 6A:
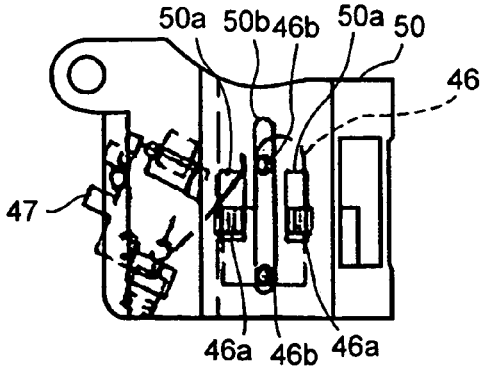
FIG. 6A is a plan view showing the pusher holder of the embodiment of the present invention, in which the pusher and cleaning member position switch are through-viewed.
Figure 6B:
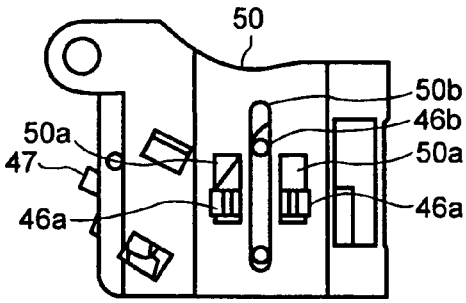
FIG. 6B is a plan view which is viewed from the pusher holder side shown in FIG. 6A.
Figure 6C:
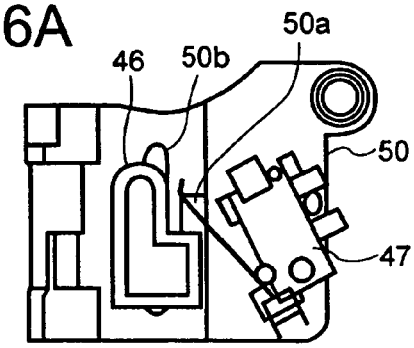
FIG. 6C is a rear view of FIG. 6A.
Figure 6D:
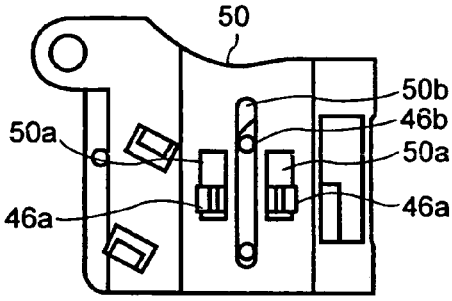
FIG. 6D is a plan view of the drawing shown in FIG. 6B excluding the cleaning member position switch.
Figure 6E:
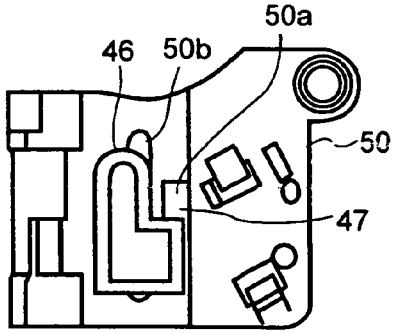
FIG. 6E is a rear view of the drawing shown in FIG. 6C excluding the cleaning member position switch.
Figure 6F:
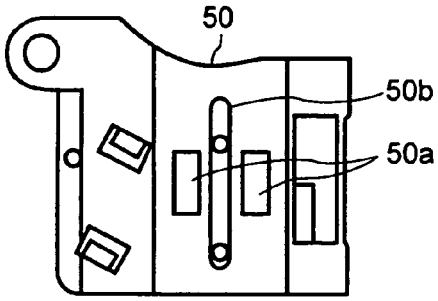
FIG. 6F is a plan view of the drawing shown in FIG. 6D excluding the pusher.
Figure 6G:
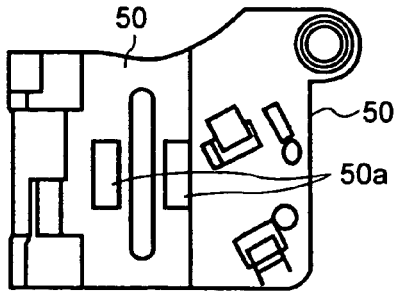
FIG. 6G is a rear view of the drawing shown in FIG. 6E excluding the pusher.
Figure 8:
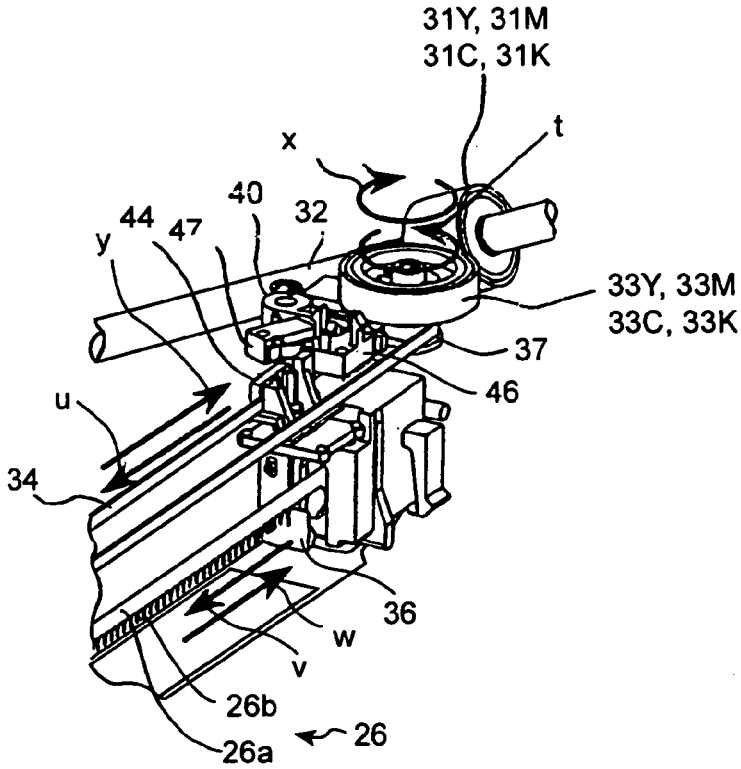
FIG. 8 is a partial perspective view showing the cleaning member moving device and drive transfer device of the embodiment of the present invention.
Figure 9:
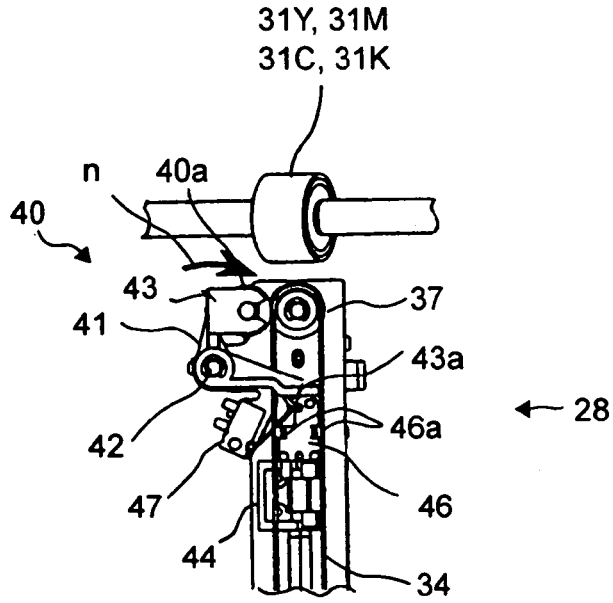
FIG. 9 is an illustration showing the cleaning member moving device and drive transfer device of the embodiment of the present invention when the pinch roller is pressurized.

Each charger cleaning device 27 is a cleaning member and cleans by rubbing the front end of needle-shape projection 26*b* of corona discharge member 26 by cleaning sheet 36 made of polyamide with a thickness of 0.05 mm shown in FIG. 8 and removing contaminants adhered to the corona discharge member 26. Charger cleaning device 27 drives cleaning member moving device 28 shown in FIG. 5 by cleaning motor 30 which is a single drive source shown in FIGS. 3 and 4. The drive by cleaning motor 30 is transferred in synchronization with all cleaning member moving devices 28 of chargers 13Y, 13M, 13C, and 13K via cleaner drive shaft 32 which is a drive transfer device and moreover cleaner drive gears 31Y, 31M, 31C, and 31K.

Cleaner member moving devices 28 have cleaner follower gears 33Y, 33M, 33C, and 33K fit into cleaner drive gears 31Y, 31M, 31C, and 31K and drive cleaner drive belt 34 to rotate. Namely, cleaner drive belt 34 is suspended between drive pulley 37 coaxial with cleaner follower gears 33Y, 33M, 33C, and 33K and follower pulley 38 installed at the other end of cleaner case 24 and is driven to rotate by the friction of the contact face with drive pulley 37.

The contact face between cleaner drive belt 34 and drive pulley 37 is pressurized by pinch roller 40*a* of pinch roller unit 40 which is a pressurizing means shown in FIG. 8, thereby obtains contact friction necessary for follower rotation of cleaner drive belt 34. Pinch roller 40*a* is supported by pinch roller holder 43 pressed by pinch roller holder pressurizing spring 41 in the direction of arrow n around rotation fulcrum 42 and always pressurizes the contact face between cleaner drive belt 34 and drive pulley 37.

To cleaner drive belt 34, a mounting member 44 for supporting cleaning sheet 36 is fixed. By cleaner drive belt 34 rotating back and forth according to the forward or backward rotation of cleaning motor 30, cleaning sheet 36 moves back and forth while rubbing the front end of needle-shaped projection 26*b* of corona discharge member 26. Furthermore, at the position symmetric to the position where mounting member 44 of cleaner drive belt 34 is fixed, a return device 48 is fixed. Return device 48 is formed exactly in the same way as with mounting member 44 when it does not have cleaning sheet 36.

Figure 7:
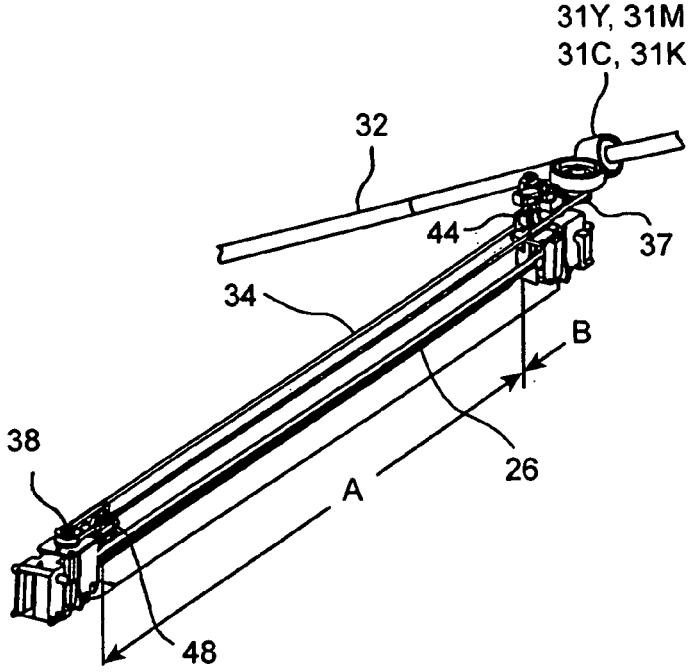
FIG. 7 is a perspective view showing the charger and drive transfer device of the embodiment of the present invention excluding the charger case and pusher holder.

Further, cleaning member moving device 28 has a return device for surely returning cleaning sheet 36 to shift area B shown in FIG. 7 after end of cleaning. The return device is a device which simultaneously transfers the drive of single cleaning motor 30 and synchronizes cleaning member moving devices 28 of chargers 13Y, 13M, 13C, and 13K, though since the timing of cleaning sheet 36 to return to shift position B is shifted due to variations at the time of manufacture and variations in the contact friction between cleaner drive belt 34 and drive pulley 37, waits for all the cleaning members to return to shift area B.

If after end of cleaning, a corona discharge is carried out when any of cleaning sheets 36 remains within charging range A shown in FIG. 7, uneven charging is caused, so that at the end time of cleaning, in all chargers 13Y, 13M, 13C, and 13K, cleaning sheet 36 must be returned surely to shift area B. Moreover, in all chargers 13Y, 13M, 13C, and 13K, while waiting for cleaning sheet 36 to return surely to shift area B, in cleaner drive belt 34 and drive pulley 37 which are returned already to shift area B, it must be taken into account to avoid friction due to slip.

The aforementioned return device is composed of pusher 46 which is a release device. As shown in FIGS. 6A to 6G, pusher 46 has pawl 46*a* and guide pin 46*b*, and pawl 46*a* is fit into hole 50*a* formed in pusher holder 50 fixed to charge case 24, and moreover guide pin 46*b* is inserted through slotted hole 50*b* and is guided and slidden by pusher holder 50.

Pusher 46 is pushed by mounting member 44 returned to shift area B. Pusher 4 is pushed by mounting member 44, thereby pushes lever 43*a* of pinch roller holder 43 in the direction of arrow q, and rotates pinch roller holder 43 in the direction of arrow r against the pressing force of pinch roller holder pressurizing spring 41. By the rotation of pinch roller holder 43 in the direction of arrow r, the pressurizing for the contact face between cleaner drive belt 34 and drive pulley 37 by pinch roller 40 is released. By the release of pressurizing of pinch roller 40, the rotation of drive pulley 37 is not transferred to cleaner drive belt 34 and drive pulley 37 rotates idle.

Further, pusher 46 also switches cleaning member position switch 47 which is a detector for detecting that cleaning sheet 36 returns to shift area B which is a predetermined position. When all cleaning member position switches 47 of chargers 13Y, 13M, 13C, and 13K detect that cleaning sheet 36 returns to shift area B, cleaning motor 30 stops the driving. Furthermore, pusher 46, similarly to the push by mounting member 44, is pushed also by return device 48 reaching shift area B by the forward movement of cleaning member 36, thereby releases the pressurization for the contact face between cleaner drive belt 34 and drive pulley 37 by pinch roller 40.

Next, the operation will be described. When image forming is started and image information is input from a scanner or a personal computer terminal, photosensitive drums 12Y, 12M, 12C, and 12K are rotated and the image forming process is sequentially executed by process units 11Y, 11M, 11C, and 11K. In process unit 11Y of yellow (Y), the surface of photosensitive drum 12Y is uniformly charged by charger 13Y, and then at exposure position 17Y, a laser beam corresponding to the image information of yellow (Y) is irradiated, and an electrostatic latent image is formed. Furthermore, a toner image is formed by developing unit 18Y, and photosensitive drum 12Y makes contact with intermediate transfer belt 10 rotating in the direction of arrow s and transfers primarily the toner image on intermediate transfer belt 10 by primary transfer roller 20Y.

Similarly to the toner image forming process of yellow (Y), the toner image forming process of magenta (M), cyan (C), and black (K) is performed. Toner images formed on photosensitive drums 12M, 12C, and 12K are transferred sequentially to the same position on intermediate transfer belt 10 as that where the toner image of yellow is formed, then reach the position of secondary transfer roller 24, and are transferred secondarily onto sheet of paper P in a batch. Thereafter, sheet of paper P is processed at the fixing step and the toner images are completed On intermediate transfer belt 10, after end of the secondary transfer, residual toner is cleaned by belt cleaner 10*a*. Further, photosensitive drums 12Y, 12M, 12C, and 12K transfer primarily the toner images to intermediate transfer belt 10, and then residual toner is removed by cleaning devices 21Y, 21M, 21C, and 21K, thus the next image forming process can be performed.

While such an image forming process is performed, contaminants are adhered to corona discharge members 26 of chargers 13Y, 13M, 13C, and 13K. When the contaminants are kept adhered, the discharge becomes uneven, and uneven charging is generated, and deterioration of the image quality is caused. Therefore, at predetermined timing or whenever necessary, corona discharge members 26 are cleaned by charger cleaning devices 27.

Firstly, cleaning motor 30 is rotated forward and cleaner drive gears 31Y, 31M, 31C, and 31K are all rotated synchronously via cleaner drive shaft 32. By doing this, in chargers 13Y, 13M, 13C, and 13K, cleaner follower gears 33Y, 33M, 33C, and 33K fit into cleaner drive gears 31Y, 31M, 31C, and 31K and moreover drive pulley 37 are rotated in the direction of arrow t. On the other hand, in pinch roller unit 40, by the pressing force of pinch roller holder pressurizing spring 41 in the direction of arrow n, pinch roller 40*a* supported by pinch roller holder 43 pressurizes the contact face between cleaner drive belt 34 and drive pulley 37. Therefore, on the contact face between cleaner drive belt 34 and drive pulley 37, sufficient contact friction necessary to drive cleaner drive belt 34 to rotate is generated, and cleaner drive belt 34 follows the rotation of drive pulley 37 in the direction of arrow t and moves forward in the direction of arrow u.

According to the forward movement of cleaner drive belt 34, cleaning sheet 36 supported by mounting member 44 moves forward in the direction of arrow v while rubbing the front end of needle-shaped projection 26*b* of corona discharge member 26 and removes contaminants adhered to corona discharge member 26. During this period, return device 48 attached to cleaner drive belt 34 at the position symmetrical to mounting member 44 moves in the direction of arrow w. Therefore, when cleaning sheet 36 moving forward in the direction of arrow v reaches the forward movement end which is the end on the side of follower pulley 38, return device 48 reaches shift area B. The timing when cleaning sheet 36 reaches the forward movement end is deviated due to variations at the time of manufacture of chargers 13Y, 13M, 13C, and 13K and variations in the contact friction between cleaner drive belt 34 and drive pulley 37.

Figure 10:
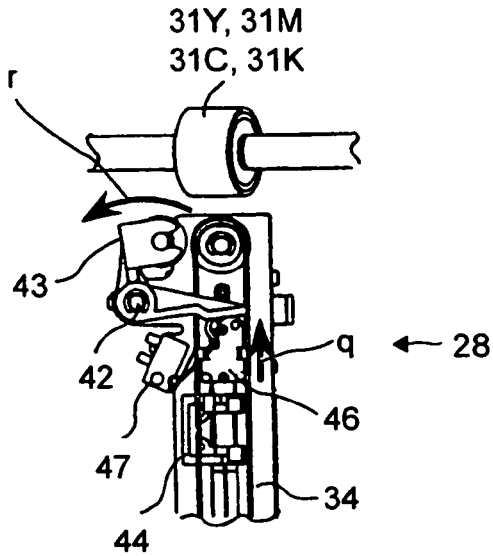
FIG. 10 is an illustration showing the cleaning member moving device and drive transfer device of the embodiment of the present invention when the pinch roller is shifted.
Figure 11:
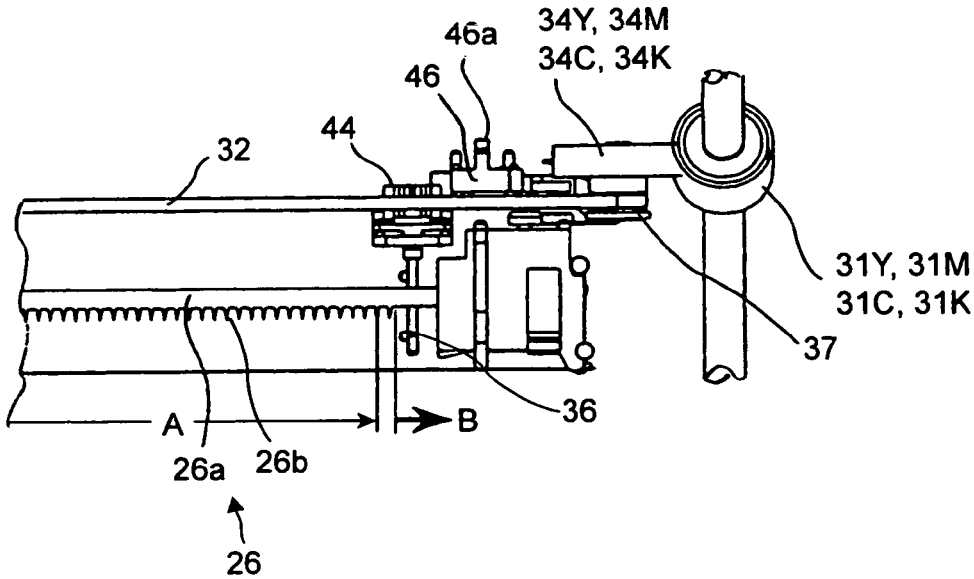
FIG. 11 is an illustration showing the cleaning member moving device and drive transfer device of the embodiment of the present invention.

In chargers 13Y, 13M, 13C, and 13K, when return device 48 reaches shift area B at the respective timing, return device 48 sequentially pushes pusher 46 in the order of arrival. By doing this, pusher 46 pushes lever 43*a* of pinch roller holder 43 in the direction of arrow q, thereby rotates pinch roller holder 43 in the direction of arrow r shown in FIG. 10 against the pressing force of pinch roller holder pressurizing spring 41. When the pressurizing on the contact face between cleaner drive belt 34 and drive pulley 37 by pinch roller 40 is released by the rotation of pinch roller holder 43 in the direction of arrow r, the driving of drive pulley 37 is not transferred to cleaner drive belt 34 and drive pulley 37 rotates idle.

However, by the idle rotation of drive pulley 37, the force of pressing lever 43*a* of pinch roller holder 43 in the direction of arrow q by pusher 46 is also released, so that pinch roller holder 43, upon receipt of the pressing force of pinch roller holder pressurizing spring 41, rotates in the direction of arrow n and applies pressure to the contact face between cleaner drive belt 34 and drive pulley 37. Therefore, the driving of drive pulley 37 is transferred again to cleaner drive belt 34, thus pusher 46 is pushed again by return device 48, and the pressurizing on the contact face between cleaner drive belt 34 and drive pulley 37 by pinch roller 40 is released.

Namely, in any optional one of chargers 13Y, 13M, 13C, and 13K where cleaning sheet 36 reaches the forward movement end, during the forward rotation of cleaning motor 30, the pressurizing and release of pressurizing on the contact face between cleaner drive belt 34 and drive pulley 37 by pinch roller 40 are repeated and the state that cleaning sheet 36 moves to the forward movement end is retained. Therefore, although drive pulley 37 rotates idle during stopping of cleaner drive belt 34, the friction force on the contact face between cleaner drive belt 34 and drive pulley 37 is small and damage due to frictional wear of cleaner drive belt 34 can be prevented.

On the other hand, in chargers 13Y, 13M, 13C, and 13K, pusher 46 turns on cleaning member position switch 47 in the order of arrival of return device 48 at shift area B. Hereafter, in all chargers 13Y, 13M, 13C, and 13K, cleaning member position switch 47 is turned on and when it is detected that all cleaning sheets 36 reach the forward movement end, cleaning motor 30 is rotated backward.

The backward rotation of cleaning motor 30 is simultaneously transferred to cleaner drive gears 31Y, 31M, 31C, and 31K via cleaner drive shaft 32 and in chargers 13Y, 13M, 13C, and 13K, cleaner follower gears 33Y, 33M, 33C, and 33K and moreover drive pulley 37 are rotated in the direction of arrow x. By doing this, the force of pushing pinch roller holder 43 by pusher 46 is released, and the contact face between cleaner drive belt 34 and drive pulley 37 is pressurized by pinch roller 40, and cleaner drive belt 34 follows the rotation of drive pulley 37 in the direction of arrow x and moves backward in the direction of arrow y.

According to the backward movement of cleaner drive belt 34, cleaning sheet 36 moves backward in the direction of arrow w while rubbing the front end of needle-shaped projection 26*b* of corona discharge member 26 and returns to shift area B while removing contaminants adhered to corona discharge member 26. During this period, return device 48 moves in the direction of arrow v. The timing when cleaning sheet 36 returns to the shift area B is deviated in chargers 13Y, 13M, 13C, and 13K. Therefore, the return timing of cleaning sheet 36 is deviated and after end of cleaning, to prevent corona discharge with cleaning sheet 36 left within charging range A shown in FIG. 7, at the time of end of cleaning, cleaning sheets 36 of all chargers 13Y, 13M, 13C, and 13K are surely returned to shift area B.

Namely, in chargers 13Y, 13M, 13C, and 13K, when mounting members 44 return to shift area B at the respective timing, mounting members 44 push pushers 46 in the order of return. By doing this, pusher 46 pushes lever 43*a* of pinch roller holder 43 in the direction of arrow q and rotates pinch roller holder 43 in the direction of arrow r shown in FIG. 10 against the pressing force of pinch roller holder pressurizing spring 41. When the pressurizing on the contact face between cleaner drive belt 34 and drive pulley 37 by pinch roller 40 is released by the rotation of pinch roller holder 43 in the direction of arrow r, the driving of drive pulley 37 is not transferred to cleaner drive belt 34 and drive pulley 37 rotates idle.

However, by the idle rotation of drive pulley 37, the force of pressing lever 43*a* of pinch roller holder 43 in the direction of arrow q by pusher 46 is also released, so that pinch roller holder 43, upon receipt of the pressing force of pinch roller holder pressurizing spring 41, returns in the direction of arrow n. By doing this, pressure is applied again to the contact face between cleaner drive belt 34 and drive pulley 37 by pinch roller 40. Therefore, the driving of drive pulley 37 is transferred again to cleaner drive belt 34, thus pusher 46 is pushed again by mounting member 44, and the pressurizing on the contact face between cleaner drive belt 34 and drive pulley 37 by pinch roller 40 is released. Namely, in any optional one of chargers 13Y, 13M, 13C, and 13K where cleaning sheet 36 returns to shift area B, during the backward rotation of cleaning motor 30, the pressurizing and release of pressurizing on the contact face between cleaner drive belt 34 and drive pulley 37 by pinch roller 40 are repeated and the state that cleaning sheet 36 is stopped in shift area B is retained. During this period, although drive pulley 37 rotates idle for cleaner drive belt 34, the friction force on the contact face between cleaner drive belt 34 and drive pulley 37 is small and damage due to frictional wear of cleaner drive belt 34 can be prevented.

Further, in chargers 13Y, 13M, 13C, and 13K, pusher 46 turns on cleaning member position switch 47 in the order of return of mounting member 44 to shift area B. Hereafter, in all chargers 13Y, 13M, 13C, and 13K, cleaning member position switches 47 are turned on and when it is detected that all cleaning sheets 36 return to the shift area B, cleaning motor 30 stops the driving, and cleaning of corona discharge members 26 by charger cleaning devices 27 is completed, and chargers 13Y, 13M, 13C, and 13K wait for the corona discharge operation.

According to this embodiment, in color image forming apparatus 1 of a tandem type, cleaning member movement devices 28 of chargers 13Y, 13M, 13C, and 13K are driven by common cleaning motor 30 at the same time, so that there is no need to install a cleaning motor for every one of chargers 13Y, 13M, 13C, and 13K, and the apparatus can be miniaturized and can be reduced in cost.

Further, although the timing when cleaning sheets 36 of chargers 13Y, 13M, 13C, and 13K are returned to shift area B is deviated, it is confirmed that cleaning sheets 36 of all chargers 13Y, 13M, 13C, and 13K are returned to shift area B and the cleaning step of corona discharge members 26 is finished. Therefore, the movement timing of cleaning sheets 36 of the plurality of chargers 13Y, 13M, 13C, and 13K is deviated, so that the cleaning sheets 36 remain within charging area A, and uneven charging can be prevented, and the image quality can be improved.

Further, cleaner drive belt 34 and drive pulley 37 are structured so as to transfer the driving by the friction of the contact face, thus according to the pressurizing and release of pressurizing of pinch roller 40*a*, transfer of the driving and release of transfer can be executed easily. Therefore, the deviation of the movement timing of cleaning sheets 36 of the plurality of chargers 13Y, 13M, 13C, and 13K is corrected, and while waiting for all cleaning sheets 36 to return to shift area B, cleaner drive belt 34 during stopping releases the pressurizing by pinch roller 40, thereby although drive pulley 37 rotates, is not damaged by frictional wear on the contact face, and can lengthen the life span. Moreover, the friction force generated on the contact face between cleaner drive belt 34 and drive pulley 34 can be easily adjusted by using the movement of cleaning sheets 36 and rotating pinch roller 40*a* via pusher 46.

Further, the present invention is not limited to the aforementioned embodiment, and within the scope of the present invention, it can be modified variously. For example, if cleaning devices of corona discharge members of a plurality of chargers arranged side by side in an image forming apparatus are driven by a common drive source, the chargers are not restricted, and transfer chargers or separation chargers may be used. Further, the corona discharge members may be grids. Further, the corona discharge members are neither restricted and wire-shaped discharge members may be used optionally. For the wire-shaped discharge members, when a grindstone slides on the discharge members as a cleaning member, contaminants of the discharge members can be cleaned effectively. Furthermore, the operation of the cleaning devices by the common drive source is not restricted, and by one cleaning operation, the movement of the cleaning members may be set only to forward movement or backward movement, or inversely, by one cleaning operation, the cleaning members may be moved back and forth several times.

As mentioned in detail above, according to the present invention, the cleaning members of a plurality of chargers arranged side by side are driven by the common drive source, so that the image forming apparatus can be miniaturized and reduced in price. Further, regardless of the deviation of the movement timing of the cleaning members for the plurality of chargers, at the time of end of cleaning, all the cleaning members are surely returned to the predetermined positions, so that uneven corona discharging can be prevented.

Further, when the cleaner drive belt and drive pulley are to be used as a cleaning member moving means, the friction force generated on the contact face of the two is adjusted and the movement or stop of the cleaner drive belt is controlled. Therefore, only by adjusting the friction force between the two due to pressurizing, the movement of the cleaner drive belt can be adjusted easily, and when the cleaner drive belt is stopped, the friction force of the two is small, and regardless of the rotation of the drive pulley, the cleaner drive belt can be prevented easily from damage due to frictional wear, and the life span can be lengthened.

What is claimed is:

1. A charger cleaning device comprising:

a plurality of cleaning members sliding respectively on wire-shaped corona discharge members of a plurality of chargers arranged side by side for removing foreign substances of the corona discharge members;

a plurality of cleaning member moving means for moving the plurality of cleaning members respectively along the corona discharge members;

a single drive source for driving the plurality of cleaning member moving means for the plurality of chargers at the same time;

a plurality of drive transferring means for transferring driving force of the single drive source respectively to the plurality of cleaning member moving means; and releasing means for releasing, when the cleaning members are returned to predetermined positions for the plurality of chargers, the transfer of the driving force of the drive source by the drive transferring means, wherein in all the chargers, when the cleaning members are returned to the predetermined positions, the drive source is stopped.

2. The charger cleaning device according to claim 1 further comprising detection device to detect that the cleaning members are returned to the predetermined positions for the plurality of chargers.

3. The charger cleaning device according to claim 1, wherein:

the cleaning member moving means has a pulley, a cleaner drive belt suspended on the pulley for supporting the cleaning members, and pressurizing means for pressurizing the cleaner drive belt to the pulley, and when pressurized by the pressurizing means, the cleaner drive belt follows the pulley, and the releasing means is pressurizing releasing means for releasing the pressurizing by the pressurizing means.

4. The charger cleaning device according to claim 3, wherein the pressurizing releasing means, when the cleaning members are returned to the predetermined positions, makes contact with the pressurizing means and pushes back the pressurizing force of the pressurizing means.

5. The charger cleaning device according to claim 4 further comprising detection means for detecting that the cleaning members are returned to the predetermined positions for the plurality of chargers, wherein the detection means are operated by the pressurizing releasing means.

6. The charger cleaning device according to claim 5, wherein the cleaner drive belt further has return means attached at a position symmetrical to a supporting position of the cleaning members and when the detection means is operated by the return means in all the chargers, inverts the drive source.

7. A charger cleaning device comprising:

a plurality of cleaning members sliding respectively on wire-shaped corona discharge members of a plurality of chargers arranged side by side for removing foreign substances of the corona discharge members;

a plurality of cleaning member moving devices to move the plurality of cleaning members respectively along the corona discharge members;

one drive source to drive the plurality of cleaning member moving devices for the plurality of chargers at the same time;

a plurality of drive transferring devices to transfer driving force of the one drive source respectively to the plurality of cleaning member moving devices; and releasing devices to release, when the cleaning members are returned to predetermined positions for the plurality of chargers, the transfer of the driving force of the drive source by the drive transferring devices, wherein in all the chargers, when the cleaning members are returned to the predetermined positions, the drive source is stopped.

8. The charger cleaning device according to claim 7 further comprising detection device to detect that the cleaning members are returned to the predetermined positions for the plurality of chargers.

9. The charger cleaning device according to claim 7, wherein:

the cleaning member moving devices have a pulley, a cleaner drive belt suspended on the pulley for supporting the cleaning members, and a pinch roller unit for pressurizing the cleaner drive belt to the pulley, and when pressurized by the pinch roller unit, the cleaner drive belt follows the pulley; and the releasing devices are pushers to push back the pinch roller in a pressurizing release direction.

10. The charger cleaning device according to claim 9, wherein the pushers, when the cleaning members are returned to the predetermined positions, make contact with the pinch roller unit and push back the pinch roller unit in a pressurizing release direction.

11. The charger cleaning device according to claim 10 further comprising detection devices to detect that the cleaning members are returned to the predetermined positions for the plurality of chargers, wherein the detection deices are operated by the pushers.

12. The charger cleaning device according to claim 11, wherein the cleaner drive belt further has a return device attached at a position symmetrical to a supporting position of the cleaning members and when the detection means are operated by the return device in all the chargers, inverts the drive source.

13. A charger cleaning method for sliding cleaning members respectively installed on cleaning member moving means on wire-shaped corona discharge members of a plurality of chargers arranged side by side and removing foreign substances of the corona discharge members, comprising:

driving the cleaning member moving means for the plurality of chargers by one drive source;

detecting that the cleaning members are returned to predetermined positions for the plurality of chargers;

releasing the driving of the cleaning member moving means by the drive source in the chargers in which the cleaning members are returned to the predetermined positions; and stopping the drive source when it is detected that the cleaning members are returned to the predetermined positions in all the chargers.

14. The charger cleaning method according to claim 13 further comprising inverting the drive source when end of forward movement of the cleaning members is detected.

15. The charger cleaning method according to claim 13, wherein:

the cleaning member moving means has a pulley, a cleaner drive belt suspended on the pulley for supporting the cleaning members, and a pinch roller for pressurizing the cleaner drive belt to the pulley, and when pressurized by the pinch roller, the cleaner drive belt follows the pulley; and the step of releasing the driving of the cleaning member moving means by the drive source pushes back the pinch roller in a pressurizing release direction by a pusher.

16. An image forming apparatus including a plurality of image forming units arranged side by side in which chargers having wire-shaped corona discharge members around image carrying members, exposure positions, developing units, and photoconductor cleaning devices are arranged, comprising:

cleaning members sliding respectively on the wire-shaped corona discharge members of the chargers for the respective image forming units and removing foreign substances of the corona discharge members;

cleaning member moving devices to respectively move the cleaning members along the corona discharge members for the respective image forming unit;

one drive source to drive the plurality of cleaning member moving devices for the respective image forming units at the same time;

a plurality of drive transferring devices to transfer driving force of the one drive source respectively to the plurality of cleaning member moving devices; and releasing devices to release, when the cleaning members are returned to predetermined positions for the respective image forming units, the transfer of the driving force of the drive source by the drive transferring devices, wherein:

in all the image forming units, when the cleaning members are returned to the predetermined positions, the drive source is stopped.

17. Then image forming apparatus according to claim 16 further comprising detection device to detect that the cleaning members are returned to the predetermined positions for the respective image forming units.

18. Then image forming apparatus according to claim 16, wherein:

the cleaning member moving devices have a pulley, a cleaner drive belt suspended on the pulley for supporting the cleaning members, and a pinch roller unit for pressurizing the cleaner drive belt to the pulley, and when pressurized by the pinch roller unit, the cleaner drive belt follows the pulley; and the releasing devices are pushers for pushing back the pinch roller in a pressurizing release direction.

19. Then image forming apparatus according to claim 18, wherein the pushers, when the cleaning members are returned to the predetermined positions, make contact with the pinch roller and push back the pinch roller in a pressurizing release direction.

20. Then image forming apparatus according to claim 19, further comprising detection devices to detect that the cleaning members are returned to the predetermined positions for the respective image forming units, wherein the detection devices are operated by the pushers.

21. Then image forming apparatus according to claim 20, wherein the cleaner drive belt further has a return device attached at a position symmetrical to a supporting position of the cleaning members and when the detection means are operated by the return device in all the chargers, inverts the drive source.

* * * * *